United States Patent [19]

Carroll

[11] 4,000,934

[45] Jan. 4, 1977

[54] ROVING CAN PISTON

[76] Inventor: Robert L. Carroll, 408 McIver, Greenville, S.C. 29601

[22] Filed: June 2, 1975

[21] Appl. No.: 582,607

Related U.S. Application Data

[63] Continuation-in-part of Ser. No. 536,968, Dec. 23, 1974, abandoned.

[52] U.S. Cl. ..... 312/71; 220/93; 211/49 D

[51] Int. Cl.[2] ..... A47F 1/00; B65D 25/10

[58] Field of Search ..... 312/71; 220/93, 253, 220/336; 211/49 D; 222/387

[56] References Cited

UNITED STATES PATENTS

| | | | |
|---|---|---|---|
| 983,437 | 2/1911 | Gray | 220/93 |
| 1,978,025 | 10/1934 | McCown | 220/93 |
| 2,022,706 | 12/1935 | Clark | 220/93 |
| 2,172,457 | 9/1939 | Schwartz | 220/93 |
| 3,022,923 | 2/1962 | Hoffman, Jr. | 220/93 |
| 3,053,410 | 9/1962 | Eaddy | 220/93 |
| 3,255,936 | 6/1966 | Healy et al. | 220/93 |
| 3,273,608 | 9/1966 | Frankenberg | 220/93 |
| 3,437,232 | 4/1969 | Goodwin, Jr. | 220/93 |
| 3,612,457 | 10/1971 | Morikawa | 312/71 |

*Primary Examiner*—Paul R. Gilliam
*Assistant Examiner*—Victor N. Sakran
*Attorney, Agent, or Firm*—Bailey, Dority & Flint

[57] ABSTRACT

A piston is provided for a roving can of the spring type wherein the piston has a cylindrical marginal skirt and an inwardly extending conical downwardly inclined surface for receiving the central portion of the sliver core so as to relieve the tendency of the sliver to form a hard central core and increase the capacity of the can. The conical surface extends adjacent the bottom of the skirt and a substantially horizontal bottom extends thereacross in order to maximize the amount of sliver which may be distributed in the can.

9 Claims, 6 Drawing Figures

Fig. 1.
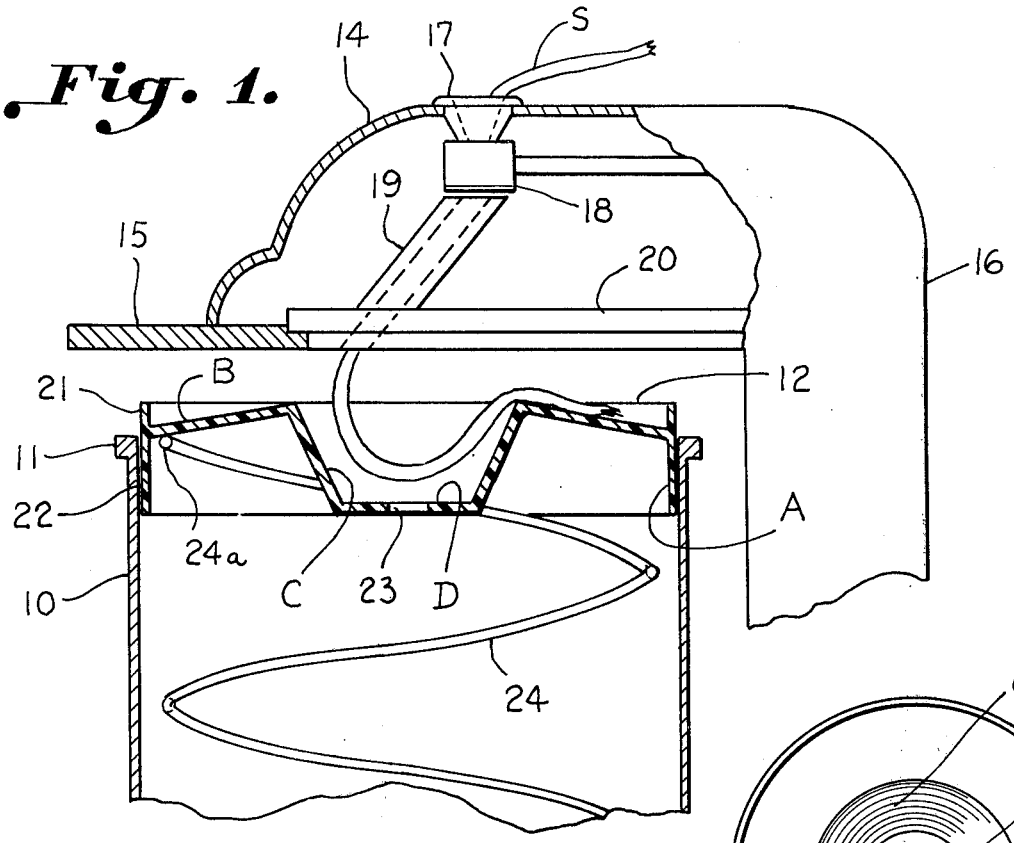
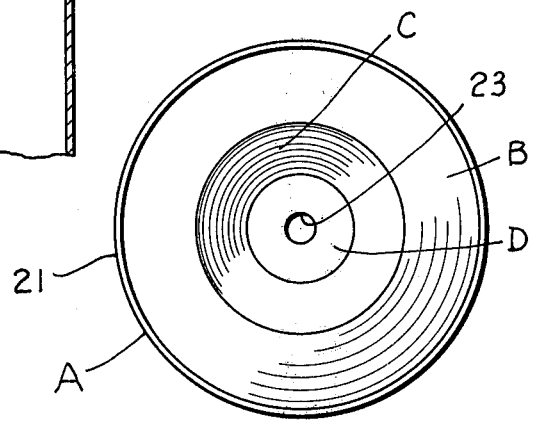
Fig. 2.
Fig. 3.
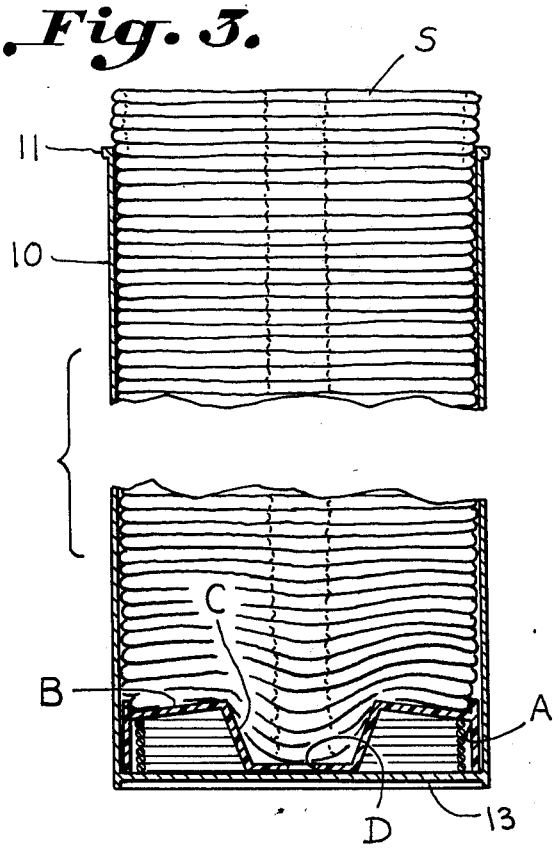
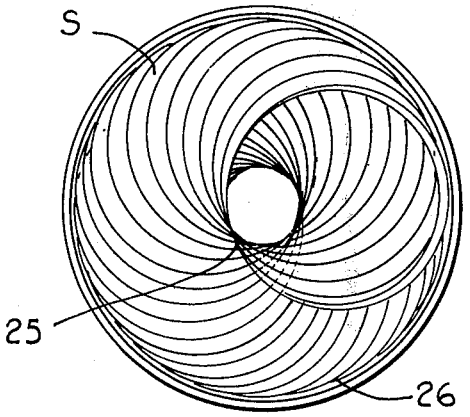
Fig. 4.

Fig. 5.
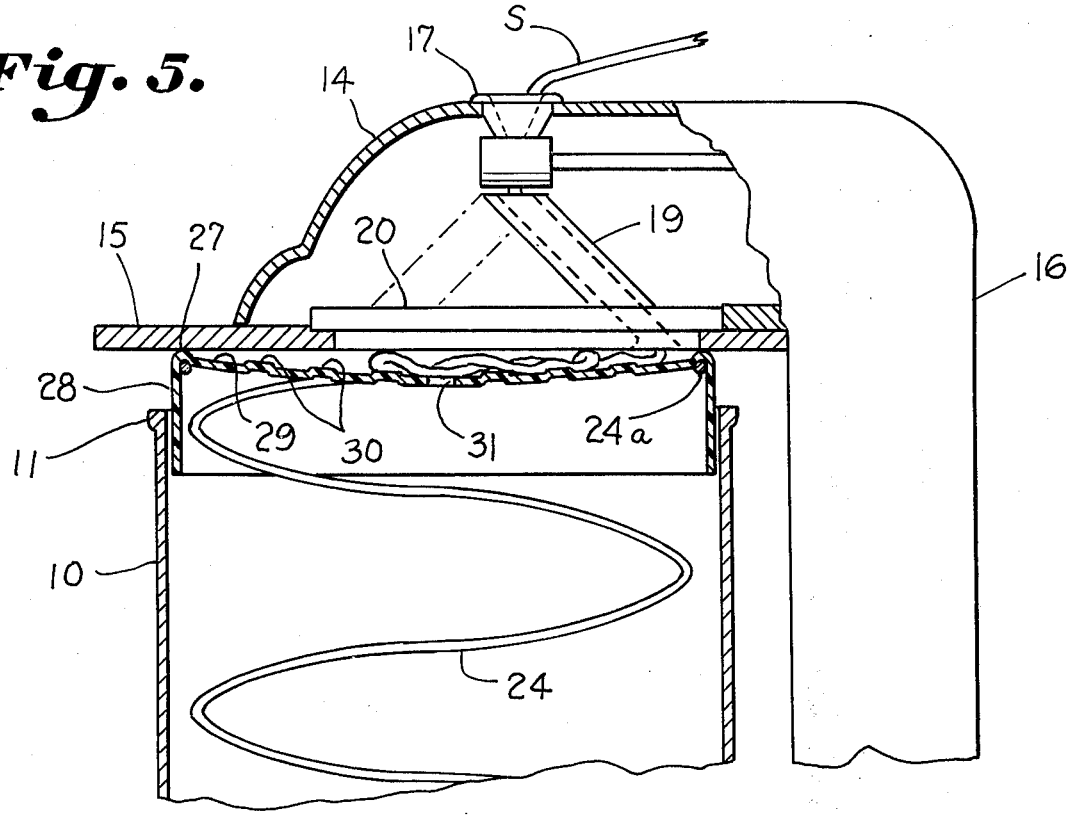
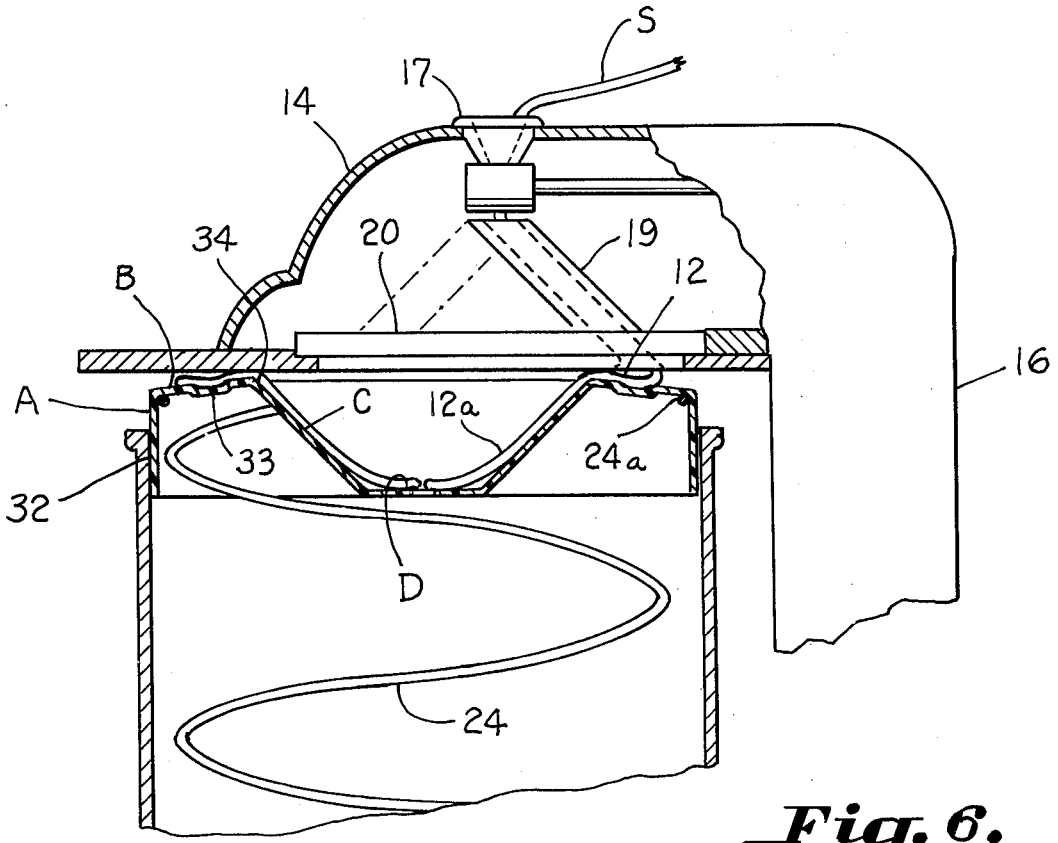
Fig. 6.

ROVING CAN PISTON

This is a continuation-in-part of copending application Ser. No. 536,968, filed Dec. 23, 1974, now abandoned.

BACKGROUND OF THE INVENTION

This invention relates to an improved piston for use in a cylindrical open topped roving can of the type having a spring biased piston such as illustrated in U.S. Pat. Nos. 3,053,410 and 3,437,232. The amount of sliver which can be placed in a roving can of the type presently in use wherein plastic pistons having depending skirts for guiding the upper surface of the piston within the can against the force of the spring is limited and there is a tendency to form a hard core of sliver within the can. When sliver is distributed upon the piston there is an overthrow of sliver past the center of the can produced by the tube gear. Since the convolutions of sliver are each thrown past the central portion of the can, there is a greater concentration of sliver in a core portion adjacent the center of the can. There is a lesser concentration of sliver formed by those portions of the sliver convolutions adjacent an outer edge of the can.

It is an object of the present invention to more evenly distribute the sliver pressure within the can and permit greater amounts of sliver to be placed within the can without damage thereto and without the formation of a hard core portion.

Another object of the invention is to more evenly distribute the sliver within the can avoiding damage thereto and maximizing the amount of sliver to be placed within the can.

BRIEF DESCRIPTION OF THE INVENTION

It has been found that by recessing the piston in its central portion and by tapering the recess and extending such recess downwardly adjacent the lower portion of the skirt that the tendency to produce a hard central core will be reduced and more sliver will be placed in the can without damage thereto.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a transverse sectional elevation illustrating a piston constructed in accordance with the present invention, installed within a sliver can, FIG. 2 is a plan view of the piston illustrated in FIG. 1, FIG. 3 is a transverse sectional elevation of a sliver can in filled condition, FIG. 4 is a top elevation of the sliver can illustrated in FIG. 1, FIG. 5 is a transverse sectional elevation illustrating a piston constructed in accordance with the prior art beneath a coiler head at startup, and FIG. 6 is a transverse sectional elevation illustrating a piston constructed in accordance with a modified form of the invention beneath a coiler head at start up.

DESCRIPTION OF A PREFERRED EMBODIMENT

The drawing illustrates a piston for use with a cylindrical open topped roving can containing a coil spring between the can bottom and the piston urging the piston upwardly within the can toward a tube gear and the like from which a sliver and the like is dispensed into the can. The piston includes a vertical cylindrical marginal skirt A within and closely adjacent a cylindrical side of the can for guiding the piston within the can. An annular inwardly extending surface B is carried adjacent an upper portion of the skirt for receiving sliver thereon. An annular downwardly inclined conical surface C extends inwardly from the first mentioned surface. A central horizontal bottom portion D bridges the downwardly inclined surface and is disposed adjacent a lower edge of the skirt. Thus, the capacity of the roving can in increased while avoiding a hard central core of sliver as often ultimately results in bad yarn.

A cylindrical open topped roving can is illustrated having a cylindrical side wall 10 and an upper rim 11 defining an open top 12. The can has a bottom 13 and is positioned beneath the coiler head which receives sliver from a card, draw frame, and the like, not shown. The coiler heat has a cover 14 and a top plate 15 supported by a coiler post 16. The coiler head cover carries a trumpet 17 which receives the sliver S. The sliver is delivered through calender rolls 18 and through a tube 19 to the tube gear 20 from whence it is delivered to an upper surface of the piston illustrated herein.

The piston is preferably constructed from a single piece of molded plastic which may be somewhat flexible. The marginal skirt A has a portion 21 projecting above the inwardly extending surface B and a lower portion 22 depending therefrom. The surface B is preferably inclined upwardly to a point where it joins the downwardly inclined conical surface C forming an upstanding annular rib. The horizontal bottom portion D has an open aperature 23 therein for convenience in lifting the piston. It will be observed that the usual coil spring 24 is carried within the can between the piston and the bottom 13 of the can. A spring 24 is illustrated as having a portion 24a contained within the skirt beneath a top portion of the piston and the spring is confined on the bottom by the bottom of the can 13. The spring is illustrated in compressed condition in FIG. 3.

By reference to FIG. 4 it will be observed that the sliver S is passed in loops, or convolutions by the tube gear extending from an outer portion of the piston and is overthrown or looped over the center portion of the can forming a relatively dense circular central core 25. It will be further observed that the portion of the next highest density, although of considerable less density, is a portion 26 adjacent a marginal portion of the piston. It has been found that by forming a cavity with the central portion of the upper surface of the piston which is tapered downwardly and inwardly so as to receive sliver in the zone of greatest density that a hard central core may be avoided and that at least 10% more sliver may be placed in the can without injury thereto.

A substantial amount of sliver is placed within the can long after the skirt has engaged the bottom of the can and often portions of the central core are excessively mashed or deformed resulting in the production of unsatisfactory or inferior yarn during further processing steps. By extending the cavity with the central portion of the piston from adjacent an upper portion of the skirt to the bottom of the skirt, an increased amount of sliver may be placed in the can and such may be done without damage to the sliver.

FIG. 5 illustrates a piston constructed in accordance with the prior art positioned within a roving can and beneath a coiler head which will be assigned the same reference characters as the coiler head and can of FIG. 1. Such pistons produce no contact with the coiler head inside the outer throw of the tube gear at start up and, therefore, do not hold the sliver. Such prior art pistons contact the tube gear 20 and plate 15 only adjacent their outer rim designated at 27 where the skirt 28 joins the concave upper surface 29 of the pistons. It will be observed that such upper surface has spaced annular raised surfaces 30 imparting strength to the upper surface and intended to act as an aid in holding the initial sliver build.

However, since there is no coaction between the piston and coiler head to hold the sliver at start up the convolutions of sliver become disarranged and tend to lie in random fashion in the dished out central portion toward the top of the piston. As is usually the case, a central opening 31 is provided in the dished out piston top. Thus, there is no positive pressure exerted between the piston and the coiler head to initiate a proper sliver buildup pattern. For convenience in illustration, the convolutions of sliver are illustrated in FIG. 4 as being deposited in circular fashion rather than the elyptical pattern normally followed by such tube gears as illustrated. In the case of the prior art, the random loops of sliver deposited on startup carry the central core which starts to build thereon as soon as sufficient fiber builds up between the piston and the coiler head. The initial fiber buildup compounds the problem of the hard central core producing damaged compacted sliver. It is the central, or hard core area that the greater part of the "scuffing" occurs due to such sliver's contact with the coiler head. While such prior art pistons are made with the top flat rather than dished out as illustrated in FIG. 5, such become dished out as shown after a little use due to the action of the hard central core deforming the top.

A piston constructed in accordance with a modified form of the invention is illustrated in FIG. 6 wherein like reference characters designate the coiler head and can. It will be noted that the upper skirt portion 21 (FIGS. 1, 2 and 3) has been omitted. The skirt A, illustrated as consisting of the annular member 32, depends from an outer marginal portion of the annular inwardly extending surface B. The inwardly extending surface B tapers upwardly and an annular channel 33 is carried therein. Such annular structure 33 acts as an aid holding the sliver at startup and imparts strength to the surface B. The surface B (as in FIGS. 1–3) is joined, inwardly of the channel 33, by the annular downwardly inclined conical surface C extending inwardly therefrom forming an upstanding rib 34. A central bottom portion D bridges the surface C adjacent a lower edge of the skirt 32. The upwardly tapering surface tends to act as a bridge resisting deformation of the top of the piston.

Pistons constructed in accordance with the present invention (FIGS. 1–4 and 6) provide positive pressure between the piston and the coiler head at startup to hold the pattern at once. The annular rib is positioned sufficiently inside the outer throw of the tube gear to engage the sliver at the start as an aid in holding the sliver at startup. As the sliver is deposited on startup loops, as illustrated in FIG. 6 at 12a extend from the outer throw of the tube gear, inwardly across the rib and into the cavity defined by the conical surface C. Initially, it will be observed that the loop 12a is not deposited or overthrown across the central portion of the piston to form a central core, but is deposited primarily along the cavity formed by the walls C. When the cavity is filled and pressure is sufficient, the central core begins to build upon the regular pattern of sliver already deposited in the can and never reaches the density as occurs utilizing prior art pistons although more sliver is placed in the can. Initially, the rib also serves to level the piston with respect to the tube gear on startup. It is important that the walls C be converging because if the cavity were rectangular, the build of the stock would force the lower layers thereof into corner recesses attenuating and damaging the sliver.

Thus, the hard central core of the prior art is substantially disrupted at startup and well into the process of filling the can, ending up with a much more even distribution of pressure even though a larger amount of stock is put in the can.

While a preferred embodiment of the invention has been described using specific terms, such description is for illustrative purposes only, and it is to be understood that changes and variations may be made without departing from the spirit or scope of the following claims.

What is claimed is:

1. A piston for use with a cylindrical open topped roving can containing a coil spring between a can bottom and said piston urging said piston upwardly within said can toward a tube gear and the like from which a sliver and the like is dispensed into the can comprising:

a vertical cylindrical marginal skirt within and closely adjacent a cylindrical side of said can for guiding said piston within the can;

an annular inwardly extending surface carried adjacent an upper portion of said skirt for receiving said sliver;

an annular downwardly inclined conical surface extending inwardly from said first mentioned surface; and a central bottom portion bridging said downwardly inclined surface disposed adjacent a lower edge of said skirt;

whereby the capacity of the roving can is increased while avoiding a hard central core of sliver as often ultimately results in faulty yarn.

2. The structure set forth in claim 1, wherein said first mentioned surface tapers inwardly and upwardly from said skirt, and an annular upstanding rib between said first mentioned surface and said downwardly inclined surface for leveling the piston with respect to the tube gear on start up.

3. The structure set forth in claim 2, wherein said annular rib is positioned sufficiently inside the outer throw of the tube gear as an aid in holding the sliver at startup.

4. The structure set forth in claim 3, including an annular structure in said first mentioned surface as an aid in holding the sliver at start up and to impart strength to the first mentioned surface.

5. The structure set forth in claim 3, wherein said skirt includes a portion extending above said first mentioned surface as well as a portion lower depending from said first mentioned surface.

6. A piston for use with an open topped roving can containing a coil spring between a can bottom and said piston urging said piston upwardly within said can toward a coiler head having a tube gear and the like from which a sliver and the like is dispensed into the can comprising:

a vertical marginal skirt within and closely adjacent a side of said can for guiding said piston within the can;

an inwardly extending surface carried adjacent an upper portion of said skirt for receiving said sliver;

a downwardly inclined substantially conical surface extending inwardly from said first mentioned surface extending downwardly adjacent a lower edge of said skirt; and means carried by said first mentioned surface positioned sufficiently inside the outer throw of the tube gear connecting with the coiler head to hold the sliver at start up;

whereby the capacity of the roving can is increased while avoiding a hard central core of sliver as often ultimately results in faulty yarn.

7. The structure set forth in claim 6, wherein said first mentioned surface is annular, tapering upwardly from said skirt; and wherein said means to hold the sliver at start up is an annular rib between said first mentioned surface and said downwardly inclined surface leveling the piston with respect to the tube gear on start up.

8. A piston for use with a cylindrical open topped roving can containing a coil spring between a can bottom and said piston urging said piston upwardly within said can toward a coiler head having a tube gear and the like from which a sliver and the like is dispensed into the can comprising:

a vertical cylindrical marginal skirt within and closely adjacent a cylindrical side of said can for guiding said piston within the can;

an annular inwardly extending surface carried adjacent an upper portion of said skirt for receiving said sliver; and an annular upstanding rib carried by said annular inwardly extending surface positioned sufficiently inside the outer throw of the tube gear coacting with the coiler head to hold the sliver and to level the piston with respect to the tube gear at startup;

whereby the capacity of the roving can is increased while avoiding a hard central core of sliver as often ultimately results in faulty yarn.

9. The structure set forth in claim 8, wherein said annular inwardly extending surface tapers upwardly from said skirt toward said rib; and including conical cavity tapering inwardly from said rib downwardly adjacent a lower edge of said skirt.

* * * * *